US011673412B2

(12) United States Patent
Tsai et al.

(10) Patent No.: US 11,673,412 B2
(45) Date of Patent: Jun. 13, 2023

(54) IMAGE FORMING DEVICE WITH A COLLAPSIBLE GUIDING MECHANISM

(71) Applicant: AVISION INC., Hsinchu (TW)

(72) Inventors: Wei-Lun Tsai, Hsinchu (TW); Min-Hao Chang, Taipei (TW)

(73) Assignee: AVISION INC., Hsinchu (TW)

( * ) Notice: Subject to any disclaimer, the term of this patent is extended or adjusted under 35 U.S.C. 154(b) by 2 days.

(21) Appl. No.: 17/411,036

(22) Filed: Aug. 24, 2021

(65) Prior Publication Data

US 2022/0072880 A1 Mar. 10, 2022

(30) Foreign Application Priority Data

Sep. 7, 2020 (TW) ..... 109130558

(51) Int. Cl.
*B41J 2/01* (2006.01)
*B41J 13/10* (2006.01)
*B41J 29/02* (2006.01)

(52) U.S. Cl.
CPC ..... *B41J 13/103* (2013.01); *B41J 29/02* (2013.01)

(58) Field of Classification Search
None
See application file for complete search history.

(56) References Cited

U.S. PATENT DOCUMENTS

| | | | | |
|---|---|---|---|---|
| 8,141,868 | B1 | 3/2012 | Wang | |
| 2005/0151315 | A1 | 7/2005 | Yokoi | |
| 2015/0097329 | A1* | 4/2015 | Ukai | B65H 1/04 271/9.12 |
| 2020/0270090 | A1* | 8/2020 | Matsumoto | B65H 31/20 |

FOREIGN PATENT DOCUMENTS

TW 201545901 A 12/2015

* cited by examiner

*Primary Examiner* — Erica S Lin
*Assistant Examiner* — Tracey M McMillion
(74) *Attorney, Agent, or Firm* — Winston Hsu

(57) ABSTRACT

An image forming device with a collapsible paper guide is provided. The image forming device includes a casing, a first tray structure and a paper guide. A medium gateway opening is formed on the casing. The first tray structure is disposed on the casing and adjacent to the medium gateway opening. The paper guide includes a first base disposed on the first tray structure and a first guiding component pivotally connected to the first base. The paper guide is switchable relative to the first tray structure between a used position and a stored position. A first included angle included between the first guiding component and the first base is less than 90 degrees when the paper guide is located at the used position, so that the first guiding component can be interfered and driven to pivotally fold for preventing the paper guide from being broken or damaged.

16 Claims, 7 Drawing Sheets

IMAGE FORMING DEVICE WITH A COLLAPSIBLE GUIDING MECHANISM

BACKGROUND OF THE DISCLOSURE

1. Field of the Disclosure

The present invention relates to an image forming device, and more specifically, to an image forming device with a collapsible guiding mechanism.

2. Description of the Prior Art

With development of equipment automation, an image forming device, such as a scanner, a printer or a multi-function apparatus, is usually provided with an automatic document transportation device to enhance performance thereof. The automatic document transportation device has capability of feeding or ejecting at least one sheet of paper, which simplifies manual operation. For example, a user can place a stack of sheets of paper on a tray, e.g., an input tray, to allow the automatic document transportation device to feed the paper one by one for scanning or printing. The tray usually includes a guiding component for guiding the paper with a same width for preventing a paper jam caused by the misaligned paper during a feeding process or an ejecting process. Furthermore, when it is not required to use the image forming device, the tray can be folded in order to prevent dust accumulation and reduce occupied space. However, the guiding component may be damaged or broken if the guiding component is not folded properly before folding the tray.

SUMMARY OF THE DISCLOSURE

Therefore, it is an objective of the present invention to provide an image forming device with a collapsible guiding mechanism for solving the aforementioned problems.

In order to achieve the aforementioned objective, the present invention discloses an image forming device with a collapsible guiding mechanism. The image forming device includes a casing, a first tray structure and a paper guide. A medium gateway opening is formed on the casing. The first tray structure is disposed on the casing and located adjacent to the medium gateway opening. The paper guide includes a first base and a first guiding component. The first base is disposed on the first tray structure. The first guiding component is pivotally connected to the first base. The paper guide is switchable relative to the first tray structure between a used position and a stored position, and a first included angle included between the first guiding component and the first base is less than 90 degrees when the paper guide is located at the used position.

According to an embodiment of the present invention, a first inclined surface is formed on an upper side of the first guiding component, and the first guiding component is driven to pivotally fold along a first folding direction when the first inclined surface is interfered.

According to an embodiment of the present invention, the paper guide further includes a first positioning structure for positioning the first guiding component, so as to ensure the first included angle included between the first guiding component and the first base to be less than 90 degrees when the paper guide is located at the used position.

According to an embodiment of the present invention, the first positioning structure includes a first resilient arm and a first restraining component. The first resilient arm is located on the first guiding component, and the first restraining component is located on the first base.

According to an embodiment of the present invention, a first guiding structure is formed on the first resilient arm. A second guiding structure is formed on the first restraining component, and the first guiding component is pivotally folded by a sliding cooperation of the first guiding structure and the second guiding structure during a switching movement of the paper guide from the used position to the stored position.

According to an embodiment of the present invention, the image forming device further includes a second base and a second guiding component. The second base is disposed on the first tray structure and located opposite to the first base. The second guiding component is pivotally connected to the second base. A second included angle included between the second guiding component and the second base is less than 90 degrees when the paper guide is located at the used position.

According to an embodiment of the present invention, a second inclined surface is formed on an upper side of the second guiding component, and the second guiding component is driven to pivotally fold along a second folding direction when the second inclined surface is interfered.

According to an embodiment of the present invention, the paper guide further includes a second positioning structure for positioning the second guiding component, so as to ensure the second included angle included between the second guiding component and the second base to be less than 90 degrees when the paper guide is located at the used position.

According to an embodiment of the present invention, the second positioning structure includes a second resilient arm and a second restraining component. The second resilient arm is located on the second guiding component, and the second restraining arm is located on the second base.

According to an embodiment of the present invention, a third guiding structure is formed on the second resilient arm. A fourth guiding structure is formed on the second restraining component, and the second guiding component is pivotally folded by a sliding cooperation of the third guiding structure and the fourth guiding structure during a switching movement of the paper guide from the used position to the stored position.

In order to achieve the aforementioned embodiment, the present invention discloses an image forming device with a collapsible guiding mechanism. The image forming device includes a casing, a first tray and a paper guide. A medium gateway opening is formed on the casing. The first tray structure is disposed on the casing and located adjacent to the medium gateway opening. The paper guide includes a first base, a second base, a first guiding component and a second guiding component. The first base is disposed on the first tray structure. The second base is disposed on the first tray structure and located opposite to the first base. The first guiding component is pivotally connected to the first base. The second guiding component is pivotally connected to the second base. The paper guide is switchable relative to the first tray structure between a used position and a stored position. When the paper guide is located at the used position, the first guiding component and the second guiding component are inclined relative to each other, so that a first virtual extending line of the first guiding component and a second virtual extending line of the second guiding component are intersected with each other to form an included angle between the first virtual extending line and the second virtual extending line.

According to an embodiment of the present invention, a first inclined surface is formed on an upper side of the first guiding component, and the first guiding component is driven to pivotally fold along a first folding direction when the first inclined surface is interfered.

According to an embodiment of the present invention, the paper guide further includes a first positioning structure for positioning the first guiding component, so as to ensure a first included angle included between the first guiding component and the first base to be less than 90 degrees when the paper guide is located at the used position.

According to an embodiment of the present invention, the first positioning structure includes a first resilient arm and a first restraining component. The first resilient arm is located on the first guiding component, and the first restraining component is located on the first base.

According to an embodiment of the present invention, a first guiding structure is formed on the first resilient arm. A second guiding structure is formed on the first restraining component, and the first guiding component is pivotally folded by a sliding cooperation of the first guiding structure and the second guiding structure during a switching movement of the paper guide from the used position to the stored position.

According to an embodiment of the present invention, a first included angle included between the first guiding component and the first base and a second included angle included between the second guiding component and the second base are respectively less than 90 degrees when the paper guide is located at the used position.

According to an embodiment of the present invention, a second inclined surface is formed on an upper side of the second guiding component, and the second guiding component is driven to pivotally fold along a second folding direction when the second inclined surface is interfered.

According to an embodiment of the present invention, the paper guide further includes a second positioning structure for positioning the second guiding component, so as to ensure the second included angle included between the second guiding component and the second base to be less than 90 degrees when the paper guide is located at the used position.

According to an embodiment of the present invention, the second positioning structure includes a second resilient arm and a second restraining component. The second resilient arm is located on the second guiding component, and the second restraining arm is located on the second base.

According to an embodiment of the present invention, a third guiding structure is formed on the second resilient arm. A fourth guiding structure is formed on the second restraining component, and the second guiding component is pivotally folded by a sliding cooperation of the third guiding structure and the fourth guiding structure during a switching movement of the paper guide from the used position to the stored position.

In summary, the paper guide of the present invention can be interfered to be folded when the image forming device is folded from a used state to a stored state. Therefore, the present invention can effectively prevent the paper guide from being damaged or broken.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "connect" is intended to mean either an indirect or direct mechanical connection. Thus, if a first device is coupled to a second device, that connection may be through a direct mechanical connection, or through an indirect mechanical connection via other devices and connections.

Figure 1:
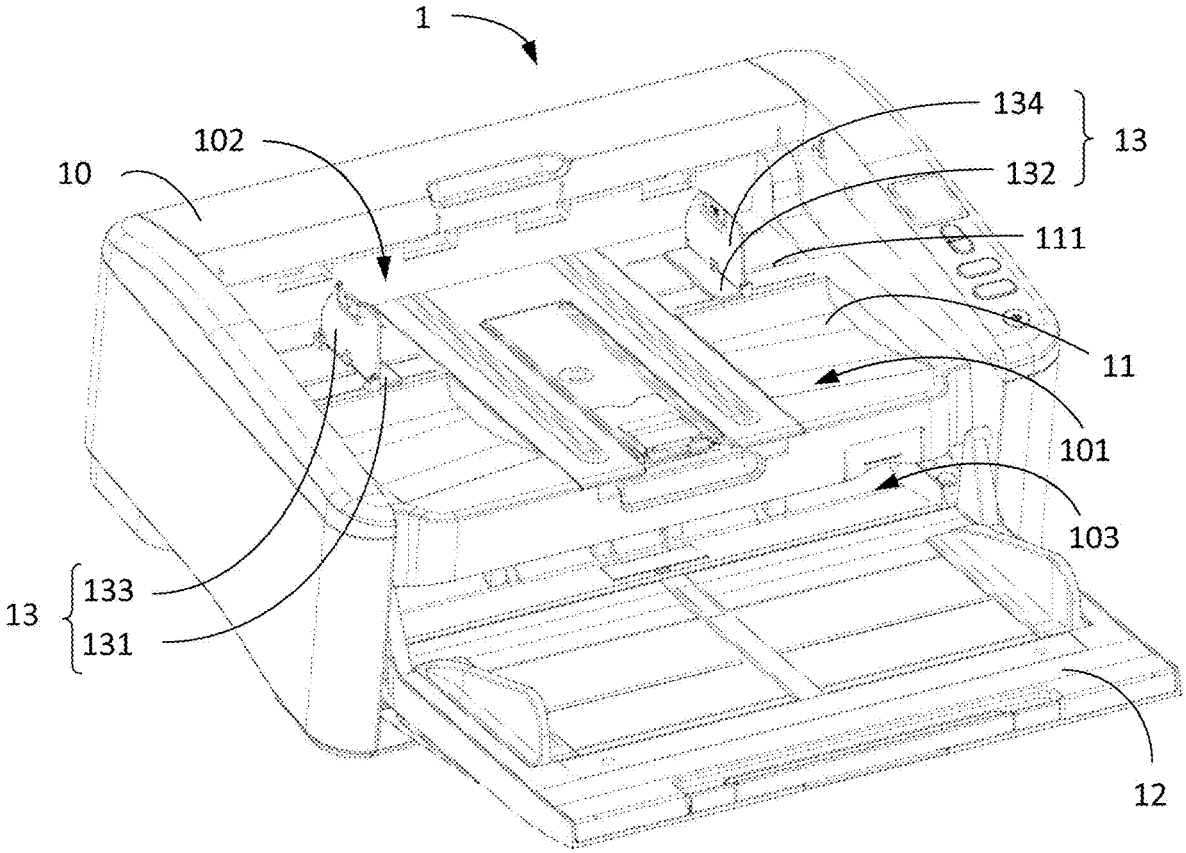
FIG. 1 to FIG. 3 are schematic diagrams of an image forming device in different states according to an embodiment of the present invention.
Figure 2:
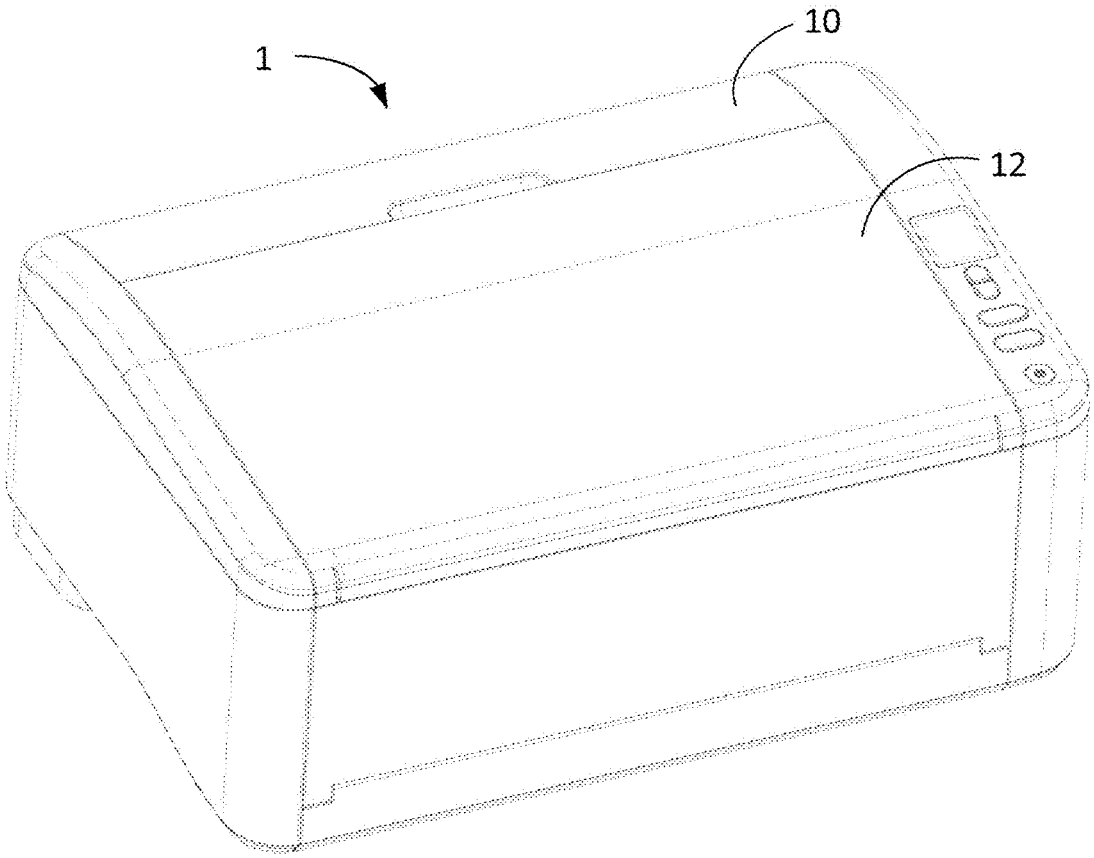
Figure 3:
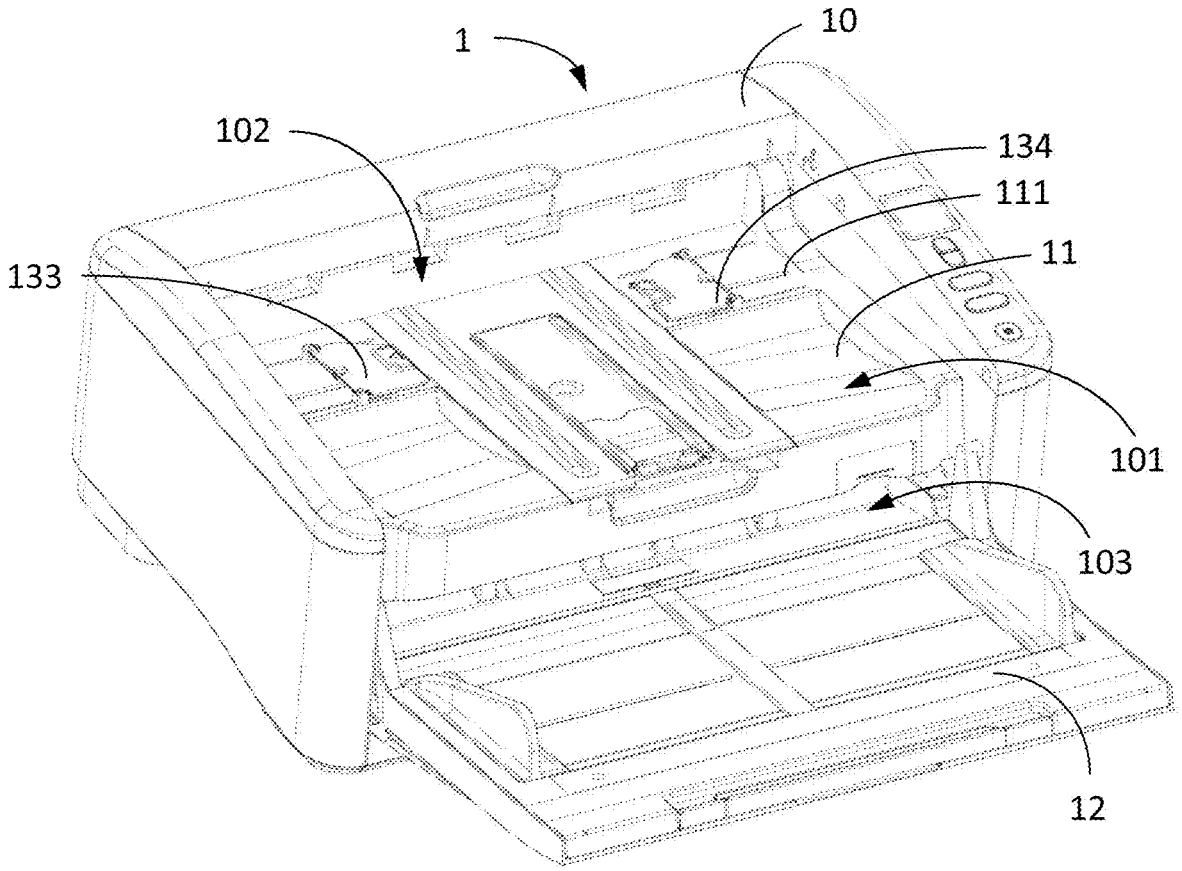

Please refer to FIG. 1 to FIG. 3. FIG. 1 to FIG. 3 are schematic diagrams of an image forming device 1 in different states according to an embodiment of the present invention. In this embodiment, the image forming device 1 can be a scanner, a printer or a multi-function apparatus. As shown in FIG. 1 to FIG. 3, the image forming device 1 includes a casing 10, a first tray structure 11 and a second tray structure 12. The casing 10 includes an accommodating space 101, a first medium gateway opening 102 and a second medium gateway opening 103. The first medium gateway opening 102 can be an exit configured to allow a medium, such as paper, to leave away from a medium gateway inside the image forming device 1. The second medium gateway opening 103 can be an entrance configured to allow the medium to enter into the medium gateway inside the image forming device 1. An automatic document feeder is disposed inside the image forming device 1 for transporting the medium from the second medium gateway opening 103 to the first medium gateway opening 102. The first tray structure 11 is fixedly or pivotally disposed on the casing 10 and located inside the accommodating space 101 and adjacent to the exit, i.e., the first tray structure 11 can be an output tray for supporting the medium. The second tray structure 12 is pivotally connected to the casing 10 and located adjacent to the entrance, i.e., the second tray structure 12 can be an input tray for supporting the medium.

The second tray structure 12 is pivotally switchable relative to the casing 10 between an unfolded position as shown in FIG. 1 and a folded position as shown in FIG. 2.

When the second tray structure 12 is pivoted to the folded position, the second tray structure 12 covers the accommodating space 101 of the casing 10. When the second tray structure 12 is pivoted to the unfolded position, a side of the second tray structure 12 is located adjacent to the second medium gateway opening 103 for supporting the medium which is about to enter into the image forming device 1 via the second medium gateway opening 103. A side of the first tray structure 11 is located adjacent to the first medium gateway opening 102 for supporting the medium which is about to leave from the image forming device 1 via the first medium gateway opening 102.

The paper guide 13 includes a first base 131, a second base 132, a first guiding component 133 and a second guiding component 134. The first base 131 and the second base 132 are disposed on the first tray structure 11 and opposite to each other. The first tray structure 11 includes a sliding slot 111 configured to allow the first base 131 and the second base 132 to move toward or away from each other relative to the first tray structure 11. The first guiding component 133 and the second guiding component 134 are pivotally connected to the first base 131 and the second base 132 respectively. The first guiding component 133 and the second guiding component 134 are configured to abut against two opposite edges of the paper and can move together with the first base 131 and the second base 132 respectively when the first base 131 and the second base 132 are moved according to a size of the paper.

When it is desired to switch the image forming device 1 to a used state as shown in FIG. 1, the second tray structure 12 can be pivotally unfolded to the unfolded position as shown in FIG. 1. At this moment, the first guiding component 133 and the second guiding component 134 can be pivotally unfolded, so that the first guiding component 133 and the second guiding component 134 can be inclined relative to each other. In other words, an first included angle between the first guiding component 133 and the first base 131 and a second included angle between the second guiding component 134 and the second base 132 can be respectively less than 90 degrees, and a virtual extending line of the first guiding component 133 and a second virtual extending line of the second guiding component 134 can be intersected with each other to form an included angle between the first virtual extending line and the second virtual extending line.

When it is desired to fold the image forming device 1 to a stored state as shown in FIG. 2, the second tray structure 12 can be pivotally folded to the folded position. At this moment, the second tray structure 12 can cover the accommodating space 101 of the image forming device 1. Furthermore, the first guiding component 133 and the second guiding component 134 can be driven to pivotally fold by the second tray structure 12, so that the guiding component 133 and the second guiding component 134 can be closely attached to the first base 131 and the second base 132 respectively. In detail, since the first guiding component 133 and the second guiding component 134 are inclined relative to each other, i.e., the first included angle between the first guiding component 133 and the first base 131 and the second included angle between the second guiding component 134 and the second base 132 are respectively less than 90 degrees, when the image forming device 1 is in the used state, the first guiding component 133 and the second guiding component 134 can be interfered by the second tray structure 12 and can be driven to pivotally fold into the accommodating space 101 along two opposite folding directions by the second tray structure 12. In this embodiment, the paper guide 13 includes a plurality of bases and a plurality of guiding components. However, the present invention is not limited to this embodiment. For example, in another embodiment, the paper guide can include only one base and one guiding component, so as to guide one edge of the medium at one side.

Figure 4:
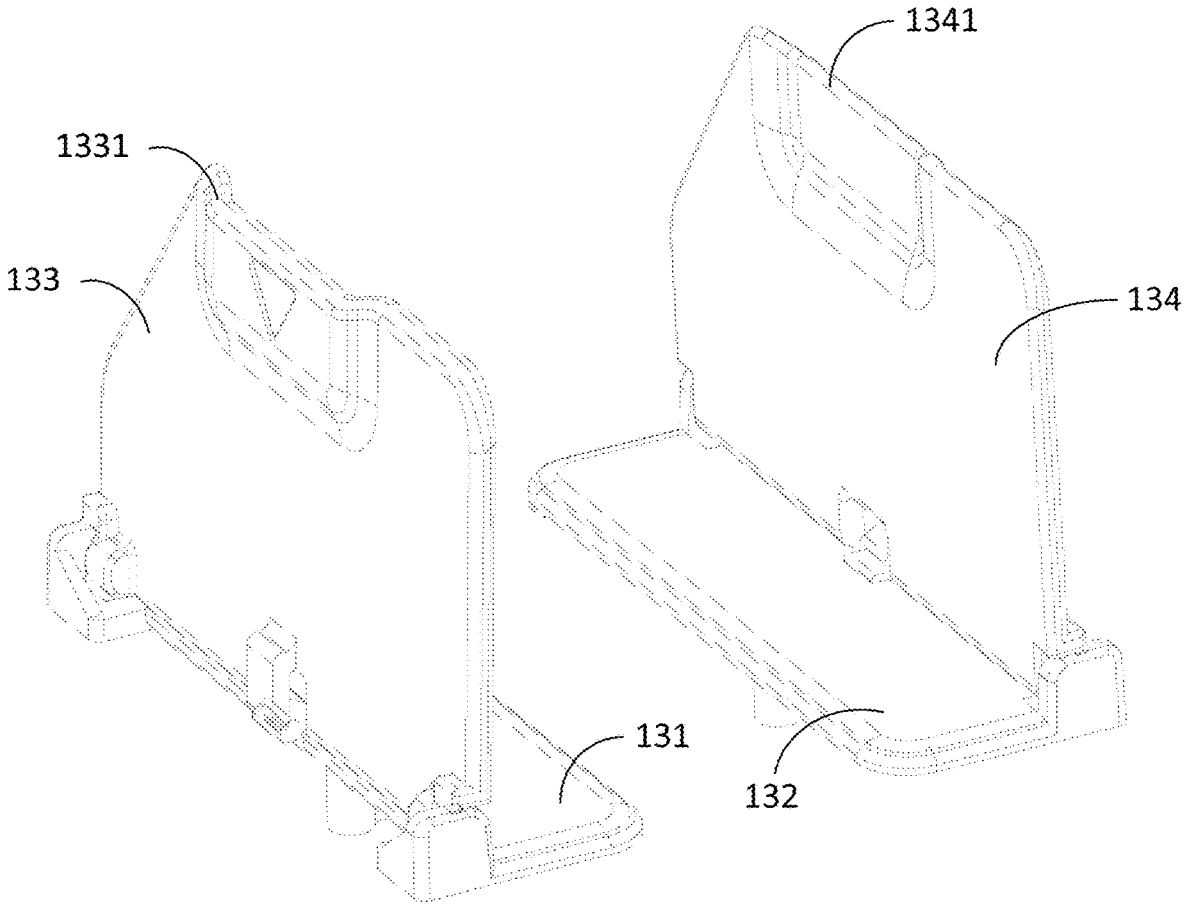
FIG. 4 is a diagram of a first guiding component and a second guiding component according to the embodiment of the present invention.
Figure 5:
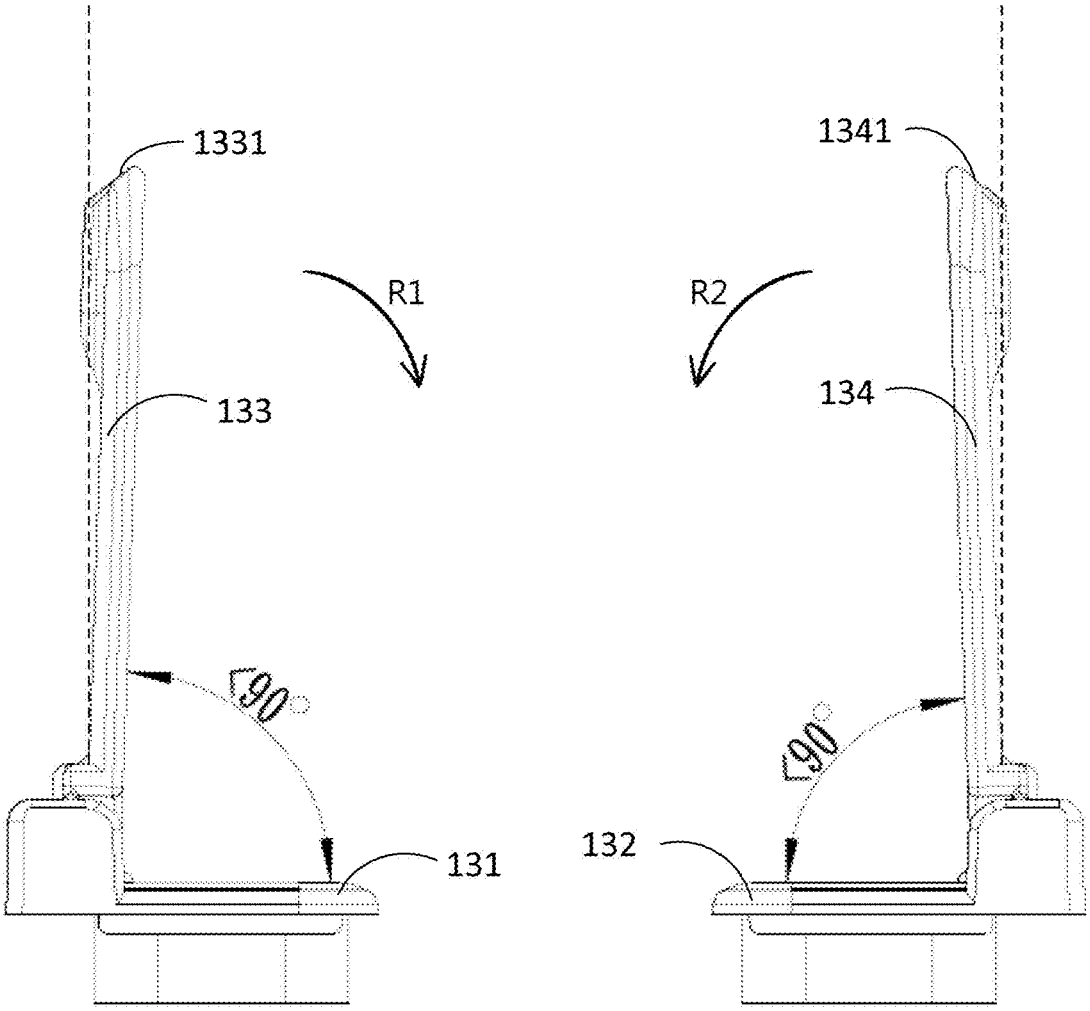
FIG. 5 is a sectional diagram of the first guiding component and the second guiding component according to the embodiment of the present invention.

Please refer to FIG. 4 and FIG. 5. FIG. 4 is a diagram of the first guiding component 133 and the second guiding component 134 according to the embodiment of the present invention. FIG. 5 is a sectional diagram of the first guiding component 133 and the second guiding component 134 according to the embodiment of the present invention. As shown in FIG. 4 and FIG. 5, a first inclined surface 1331 and a second inclined surface 1341 can be formed on upper sides of the first guiding component 133 and the second guiding component 134 respectively. By interference of the first inclined surface 1331 and the second tray structure 12 and interference of the second inclined surface 1341 and the second tray structure 12, the first guiding component 133 and the second guiding component 134 can be respectively driven to pivotally fold along a first folding direction R1 and a second folding direction R2 easily and smoothly.

Figure 6:
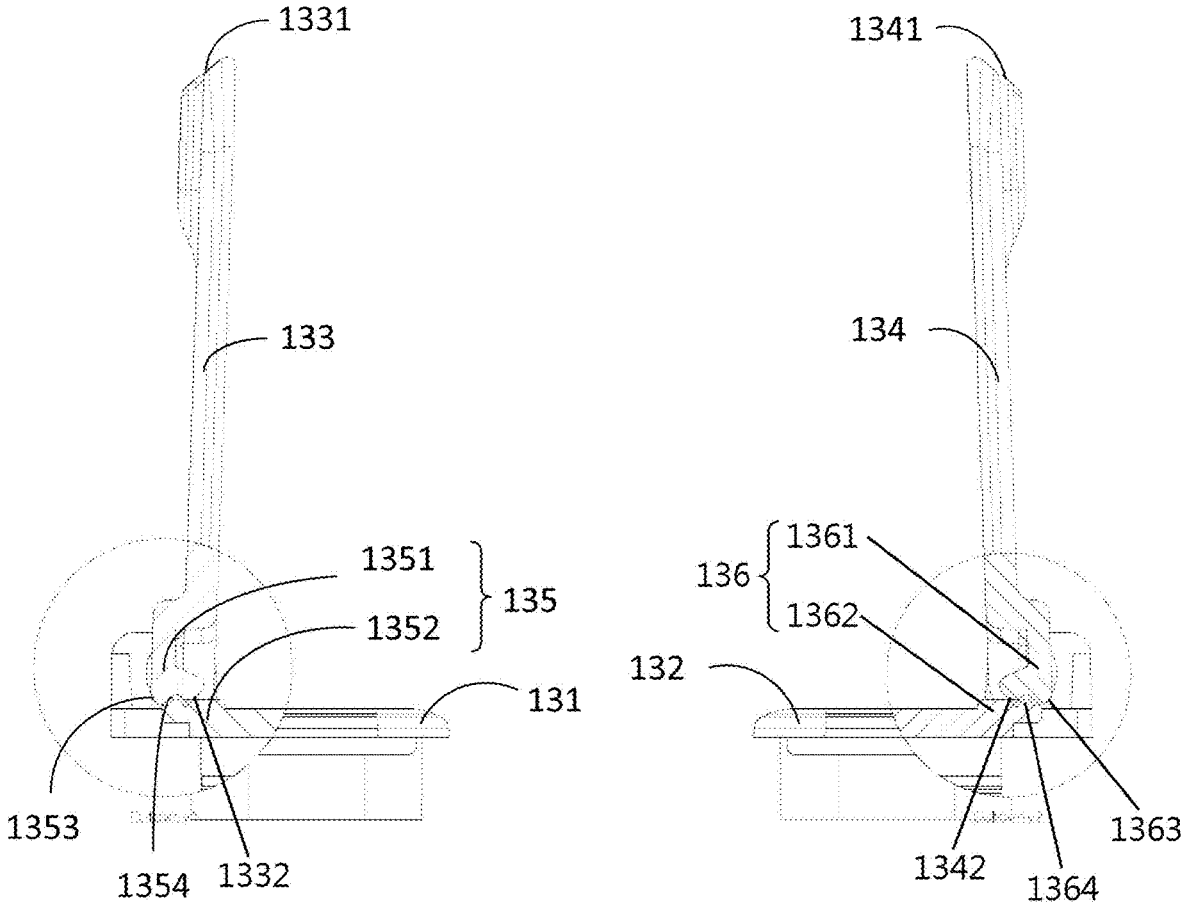
FIG. 6 is a partial enlarged sectional diagram of the first guiding component and the second guiding component according to the embodiment of the present invention.

Furthermore, please refer to FIG. 6. FIG. 6 is a partial enlarged sectional diagram of the first guiding component 133 and the second guiding component 134 according to the embodiment of the present invention. As shown in FIG. 6, a first surface 1332 of the first guiding component 133 adjacent to the first base 131 and a second surface 1342 of the second guiding component 134 adjacent to the second base 132 can be arc-shaped surfaces. When the first guiding component 133 and the second guiding component 134 are interfered by the second tray structure 12 and driven to pivotally fold by the second tray structure 12, the first surface 1332 and the second surface 1342 can prevent interference between the first guiding component 133 and the first base 131 and interference between the second guiding component 134 and the second base 132 to allow the first guiding component 133 and the second guiding component 134 to be pivotally folded easily and smoothly.

As shown in FIG. 4 to FIG. 6, the paper guide 13 further includes a first positioning structure 135 and a second positioning structure 136. When the first guiding component 133 and the second guiding component 134 are pivotally unfolded relative to the first tray structure 11, the first positioning structure 135 and the second positioning structure 136 can restrain the first guiding component 133 and the second guiding component 134 respectively, so as to ensure the first included angle between the first guiding component 133 and the first base 131 and the second included angle between the second guiding component 134 and the second base 132 respectively to be less than 90 degrees, i.e., to prevent the first paper guide 133 and the second paper guide 134 from opening more than 90 degrees, for ensuring the first guiding component 133 and the second guiding component 134 to be inclined relative to each other. The first positioning structure 135 includes a first resilient arm 1351 and a first restraining component 1352, wherein the first resilient arm 1351 is formed on the first guiding component 133, and the first restraining component 1352 is formed on the first base 131. When the first guiding component 133 is pivotally unfolded relative to the first tray structure 11, the first resilient arm 1351 on the first guiding component 133 can engage with the first restraining component 1352 on the first base 131, so as to ensure the first included angle between the first guiding component 133 and the first base 131 to be less than 90 degrees. The second positioning structure 136 includes a second resilient arm 1361 and a second restraining component 1362, wherein the second resilient arm 1361 is formed on the second guiding component 134, and the second restraining component 1362 is formed on the second base 132. When the second guiding component 134 is pivotally unfolded relative to the first tray structure 11, the second resilient arm 1361 on the second guiding component 134 can engage with the second restraining component 1362 on the second base 132, so as to ensure the second included angle between the second guiding component 134 and the second base 132 to be less than 90 degrees.

As shown in FIG. 6, in order to allow the first guiding component 133 and the second guiding component 134 to be folded easily and smoothly, in this embodiment, a first guiding structure 1353 is formed on the first resilient arm 1351, and a second guiding structure 1354 is formed on the first restraining component 1352. When the paper guide 13 is folded from the used position to the stored position, the first guiding component 133 can be pivotally folded by a sliding cooperation of the first guiding structure 1353 and the second guiding structure 1354. Similarly, a third guiding structure 1363 is formed on the second resilient arm 1361, and a fourth guiding structure 1364 is formed on the second restraining component 1362. When the paper guide 13 is folded from the used position to the stored position, the second guiding component 134 can be pivotally folded by a sliding cooperation of the third guiding structure 1363 and the fourth guiding structure 1364. In this embodiment, the first guiding structure 1353, the second guiding structure 1354, the third guiding structure 1363 and the fourth guiding structure 1364 can be arc-shaped structures. However, the present invention is not limited to this embodiment.

Figure 7:
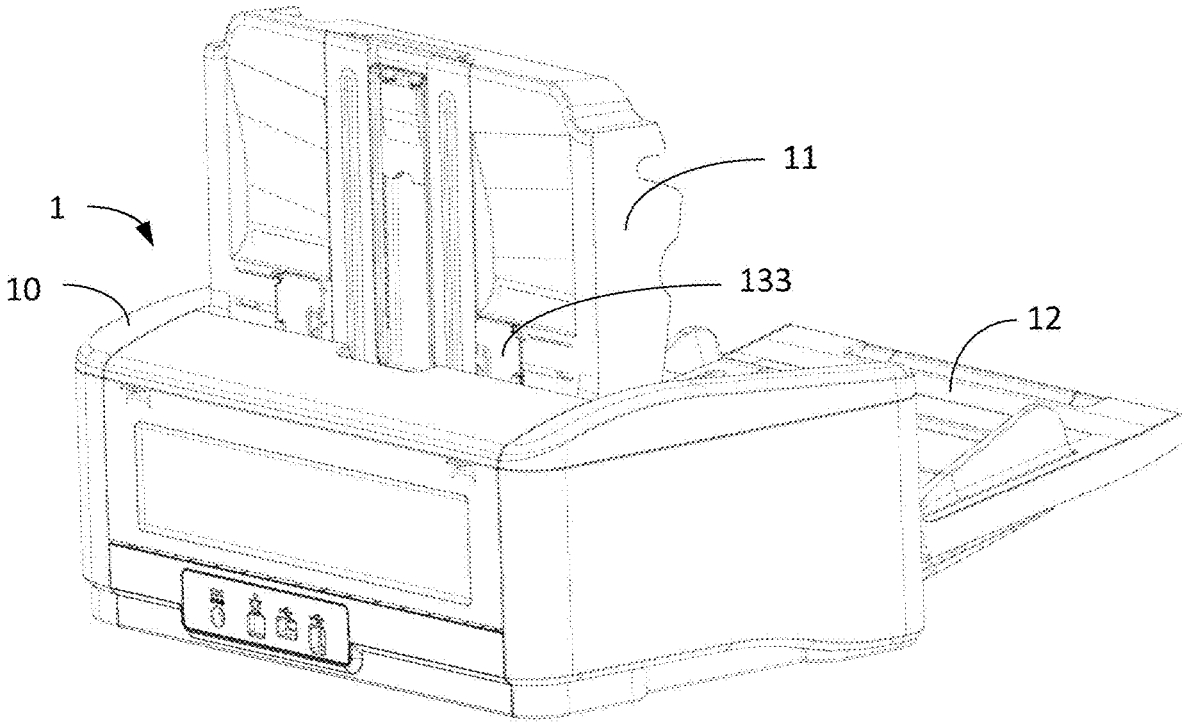
FIG. 7 is a schematic diagram of the image forming device in another state according to the embodiment of the present invention.

Please refer to FIG. 7. FIG. 7 is a schematic diagram of the image forming device 1 in another state according to the embodiment of the present invention. As shown in FIG. 7, in addition to the aforementioned mechanism, when it is required to troubleshoot the image forming device 1 by pivotally unfolding the first tray structure 11 upwardly, the first guiding component 133 and the second guiding component 134 also can be interfered by the casing 10 and driven to pivotally fold by the casing 10 in order to prevent the first guiding component 133 and the second guiding component 134 from being damaged or broken during an unfolding movement of the first tray structure 11. In detail, the first guiding component 133 and the second guiding component 134 are inclined relative to each other when the paper guide 13 is located at the used position. Therefore, even if the first guiding component 133 and the second guiding component 134 are not folded before the first tray structure 11 is unfolded upwardly, the first guiding component 133 and the second guiding component 134 can be interfered by the casing 10 and driven to pivotally fold by the casing 10 to prevent the first guiding component 133 and the second guiding component 134 from being damaged or broken during the unfolding movement of the first tray structure 11.

However, the present invention is not limited to the aforementioned embodiment. For example, in another embodiment, the first tray structure and the second tray structure can be an input tray pivotally disposed on the casing and an output tray fixedly located in the accommodating space of the casing respectively. When the first tray structure is pivoted from the unfolded position to the folded position, the first guiding component and the second guiding component disposed on the first tray structure can be interfered by the second tray structure or any other structure in the accommodating space and driven to pivotally fold along different folding directions.

In summary, the paper guide of the present invention can be interfered to be folded when the image forming device is folded from the used state to the stored state. Therefore, the present invention can effectively prevent the paper guide from being damaged or broken.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. An image forming device with a collapsible guiding mechanism, the image forming device comprising:
- a casing, a medium gateway opening being formed on the casing;
- a first tray structure disposed on the casing and located adjacent to the medium gateway opening; and
- a paper guide comprising:
  - a first base disposed on the first tray structure;
  - a first guiding component pivotally connected to the first base; and
  - a first positioning structure for positioning the first guiding component;
- wherein the paper guide is switchable relative to the first tray structure between a used position and a stored position, a first included angle included between the first guiding component and the first base is less than 90 degrees when the paper guide is located at the used position, the first positioning structure comprises a first resilient arm and a first restraining component, the first resilient arm is located on the first guiding component, the first restraining component is located on the first base, the first resilient arm engages with the first restraining component for positioning the first guiding component to ensure the first included angle included between the first guiding component and the first base to be less than 90 degrees when the paper guide is located at the used position.

2. The image forming device of claim 1, wherein a first inclined surface is formed on an upper side of the first guiding component, and the first guiding component is driven to pivotally fold along a first folding direction when the first inclined surface is interfered.

3. The image forming device of claim 1, wherein a first guiding structure is formed on the first resilient arm, a second guiding structure is formed on the first restraining component, and the first guiding component is pivotally folded by a sliding cooperation of the first guiding structure and the second guiding structure during a switching movement of the paper guide from the used position to the stored position.

4. The image forming device of claim 1, wherein the paper guide further comprises:
- a second base disposed on the first tray structure and located opposite to the first base; and
- a second guiding component pivotally connected to the second base;
- wherein a second included angle included between the second guiding component and the second base is less than 90 degrees when the paper guide is located at the used position.

5. The image forming device of claim 4, wherein a second inclined surface is formed on an upper side of the second guiding component, and the second guiding component is driven to pivotally fold along a second folding direction when the second inclined surface is interfered.

6. The image forming device of claim 4, wherein the paper guide further comprises a second positioning structure for positioning the second guiding component, so as to ensure the second included angle included between the second guiding component and the second base to be less than 90 degrees when the paper guide is located at the used position.

7. The image forming device of claim 6, wherein the second positioning structure comprises a second resilient arm and a second restraining component, the second resilient arm is located on the second guiding component, and the second restraining arm is located on the second base.

8. The image forming device of claim 7, wherein a third guiding structure is formed on the second resilient arm, a fourth guiding structure is formed on the second restraining component, and the second guiding component is pivotally folded by a sliding cooperation of the third guiding structure and the fourth guiding structure during a switching movement of the paper guide from the used position to the stored position.

9. An image forming device with a collapsible guiding mechanism, the image forming device comprising:

a casing, a medium gateway opening being formed on the casing;

a first tray structure disposed on the casing and located adjacent to the medium gateway opening; and a paper guide comprising:

a first base disposed on the first tray structure;

a second base disposed on the first tray structure and located opposite to the first base;

a first guiding component pivotally connected to the first base;

a first positioning structure for positioning the first guiding component; and a second guiding component pivotally connected to the second base;

wherein the paper guide is switchable relative to the first tray structure between a used position and a stored position, when the paper guide is located at the used position, the first guiding component and the second guiding component are inclined relative to each other, so that a first virtual extending line of the first guiding component and a second virtual extending line of the second guiding component are intersected with each other to form an included angle between the first virtual extending line and the second virtual extending line, the first positioning structure comprises a first resilient arm and a first restraining component, the first resilient arm is located on the first guiding component, the first restraining component is located on the first base, the first resilient arm engages with the first restraining component for positioning the first guiding component to ensure the first virtual extending line and the second virtual extending line to be intersected with each other when the paper guide is located at the used position.

10. The image forming device of claim 9, wherein a first inclined surface is formed on an upper side of the first guiding component, and the first guiding component is driven to pivotally fold along a first folding direction when the first inclined surface is interfered.

11. The image forming device of claim 9, wherein a first guiding structure is formed on the first resilient arm, a second guiding structure is formed on the first restraining component, and the first guiding component is pivotally folded by a sliding cooperation of the first guiding structure and the second guiding structure during a switching movement of the paper guide from the used position to the stored position.

12. The image forming device of claim 9, wherein a first included angle included between the first guiding component and the first base and a second included angle included between the second guiding component and the second base are respectively less than 90 degrees when the paper guide is located at the used position.

13. The image forming device of claim 9, wherein a second inclined surface is formed on an upper side of the second guiding component, and the second guiding component is driven to pivotally fold along a second folding direction when the second inclined surface is interfered.

14. The image forming device of claim 9, wherein the paper guide further comprises a second positioning structure for positioning the second guiding component, so as to ensure the second included angle included between the second guiding component and the second base to be less than 90 degrees when the paper guide is located at the used position.

15. The image forming device of claim 14, wherein the second positioning structure comprises a second resilient arm and a second restraining component, the second resilient arm is located on the second guiding component, and the second restraining arm is located on the second base.

16. The image forming device of claim 15, wherein a third guiding structure is formed on the second resilient arm, a fourth guiding structure is formed on the second restraining component, and the second guiding component is pivotally folded by a sliding cooperation of the third guiding structure and the fourth guiding structure during a switching movement of the paper guide from the used position to the stored position.

* * * * *